US006542132B2

(12) United States Patent
Stern

(10) Patent No.: US 6,542,132 B2
(45) Date of Patent: Apr. 1, 2003

(54) DEPLOYABLE REFLECTOR ANTENNA WITH TENSEGRITY SUPPORT ARCHITECTURE AND ASSOCIATED METHODS

(75) Inventor: Ian Stern, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 13 days.

(21) Appl. No.: 09/879,539

(22) Filed: Jun. 12, 2001

(65) Prior Publication Data

US 2002/0190918 A1 Dec. 19, 2002

(51) Int. Cl.[7] ..... H01Q 15/20
(52) U.S. Cl. ..... 343/915; 343/880
(58) Field of Search ..... 343/912, 915, 343/916, 840, 880; H01Q 15/14, 15/16, 15/20

(56) References Cited

U.S. PATENT DOCUMENTS 4,527,166 A * 7/1985 Luly ..... 343/840
5,642,590 A 7/1997 Skelton ..... 52/81.1

OTHER PUBLICATIONS

Article on "Review Assessment of Satellite Communications Technologies" published in Jul. 1993 by WTEC Hyper– Librarian, pp. 1–14.
ESA—"A Multipurpose Deployabe Membrane Reflector—A New Design Concept" by W.J. Rits published in ESA bulletin No. 88 in Nov. 1996 by ESA–ESRIN/ID/D.
UF News for 21st Century Campers and Soldiers, "A Tent that sets itself up" by Aaron Hoover dated Dec. 13, 1999.
Article on "Furlable Reflector Concept for Small Satellites" by A.G. Tilbert and S. Pellegrino published by the American Institute for Aeronautics and Astronautics.

* cited by examiner

*Primary Examiner*—Michael C. Wimer
(74) *Attorney, Agent, or Firm*—Allen, Dyer, Doppelt, Milbrath & Gilchrist, P.A.

(57) ABSTRACT

The deployable antenna with the tensegrity support structure and mounting frame has improved specific mass, compact stowage volume and high deployment reliability. The reflector is mounted to the tensegrity support structure via the mounting frame which ensures proper deployment of the reflector in the desired antenna operating shape.

30 Claims, 7 Drawing Sheets

DEPLOYABLE REFLECTOR ANTENNA WITH TENSEGRITY SUPPORT ARCHITECTURE AND ASSOCIATED METHODS

FIELD OF THE INVENTION

The present invention relates to radio wave antennas, and, more particularly, to deployable antennas including tensegrity support architecture.

BACKGROUND OF THE INVENTION

The field of deployable structures, such as space-deployed platforms, has matured significantly in the past decade. What once was a difficult art to master has been developed into a number of practical applications by commercial enterprises. The significance of this maturity has been the reliable deployment of various spacecraft-supported antenna systems, similar to that employed by the NASA tracking data and relay satellite (TDRS). In recent years, the development of parabolic, mesh-surface, reflector geometries has been accompanied by improvements in phased arrays (flat panel structures with electronically steered beams), both of which are critical to commercial and defense space programs. As commercial spacecraft production has exceeded military/civil applications, there is currently a demand for structural systems with proven reliability and performance, and the ever present reduced cost.

The mission objective for a large, deployable space antenna is to provide reliable radio frequency (RF) energy reflection to an electronic collector (feed) located at the focus of the parabolic surface. The current state of deployable parabolic space antenna design is principally based on what may be termed a segmented construction approach which is configured much like an umbrella. In this type of design, a plurality of radial ribs or segments are connected to a central hub, that supports an antenna feed. A mechanical advantaged linear actuator is used to drive the segments from their stowed or unfurled condition into a locked, over-driven, position, so as to deploy a surface. A shortcoming of a single fold design of this type of antenna is the fact that the height of the stowed package is over one half of the deployed diameter. Other proposals include the use of hoop tensioners and mechanical memory surface materials.

In recent years, numerous Defense Department organizations have solicited for new approaches to deployable antenna structures. The Air Force Research Laboratories (AFRL) are interested in solutions to aid with their Space Based Laser and Radar programs, and have requested new solutions to building precision deployable structures to support the optical and radar payloads. These requests are based upon the premise that the stowed density for deployable antennas can be significantly increased, while maintaining the reliability that the space community has enjoyed in the past. A failure of these structures is unacceptable. If the stowed volume can be reduced (therefore an increase in density for a given weight), launch services can be applied more efficiently.

The implementation of multiple vehicle launch platforms (e.g., the Iridium satellite built by Motorola) has presented a new case where the launch efficiency is a function of the stowed spacecraft package, and not the weight of the electronic bus. For extremely high frequency (EHF) systems (greater than 20 GHz) in low earth orbit (LEO), the antenna aperture needs to be only a few meters in diameter. However, for an L-band, geosynchronous orbit satellite (such AceS built by Lockheed Martin), the antenna aperture diameter is fifty feet. Less weight and payload drag must be achieved to ensure a more efficient assent into a geosynchronous orbit.

Tetrobots have been developed in the last few years as a new approach to modular design. The tetrobot approach, which is described in the text by G. Hamlin et al, entitled: "TETROBOT, A Modular Approach to Reconfigurable Parallel Robotics," Kluwer Academic Publishers, 1998 (ISBN: 0-7923-8025-8) utilizes a system of hardware components, algorithms, and software to build various robotic structures to meet multiple design needs. These structures are Platonic Solids (tetrahedral and octahedral modules), with all the connections made with truss members. Adaptive trusses have been applied to the field of deployable structures, providing the greatest stiffness and strength for a given weight of any articulated structure or mechanism.

The most complex issue in developing a reliable deployable structure design is the packaging of a light weight subsystem in as small a volume as possible, while ensuring that the deployed structure meets system requirements and mission performance. An article by D. Warnaar, entitled: Evaluation Criteria for Conceptual of Deployable-Foldable Truss Structures," ASME Design Engineering: Mechanical Design and Synthesis, Vol. 46, pp. 167–173, 1992, in describing criteria developed for deployable-foldable truss structures, addresses the issues of conceptual design, storage space, structural mass, structural integrity, and deployment. This article simplifies the concepts related to a stowed two-dimensional area deploying to a three-dimensional volume. A tutorial on deployable-foldable truss structures is presented in: "Conceptual Design of Deployable-Foldable Truss Structures Using Graph Theory-Part 1: Graph Generation," by D. Warnaar et al, ASME 1990 Mechanisms Conference, pp. 107–113, September 1990, and "Conceptual Design of Deployable-Foldable Truss Structures Using Graph Theory-Part 2: Generation of Deployable Truss Module Design Concepts, by D. Warnaar et al, ASME, 1990 Mechanisms Conference, pp. 115–125, September 1990. This series of algorithms presents a mathematical representation for the folded (three-dimensional volume in a two-dimensional area) truss, and aids in determining the various combinations for a folded truss design.

NASA's Langley Research Center has extensive experience in developing truss structures for space. One application, a 14-meter diameter, three-ring optical truss, was designed for space observation missions. An article by K. Wu et al, entitled: "Multicriterion Preliminary Design of a Tetrahedral Truss Platform," Journal of Spacecraft and Rockets, Vol. 33, No. 3, May–June 1996, pp. 410–415, details a design study that was performed using the Taguchi methods to define key parameters for a Pareto-optimal design: maximum structural frequency, minimum mass, and the maximum frequency to mass ratio. In the study, tetrahedral cells were used for the structure between two precision surfaces. 31 analyses were performed on 19,683 possible designs with an average frequency-to-mass ratio between 0.11 and 0.13 Hz/kg. This results in an impressive 22 to 26 Hz for a 200-kg structure.

The field of deployable space structures has proven to be both technically challenging and financially lucrative during the last few decades. Such applications as large parabolic antennas require extensive experience and tooling to develop, but is a key component to the growing personal communications market. Patents relating to deployable space structures have typically focused on the deployment of general truss network designs, rather than specific antenna designs. Some of these patents address new approaches that have not been seen in publication.

For example, the U.S. patents to Kaplan et al, U.S. Pat. No. 4,030,102, and Waters et al, U.S. Pat. No. 4,825,225 describe the application of strut and tie construction to deployable antennas. However, the majority of patents address trusses and the issues associated with their deployment and minimal stowage volume. For example, the U.S. patent to Nelson U.S. Pat. No. 4,539,786 describes a design for a three-dimensional rectangular volume based on an octahedron. Deployment uses a series of ties within the truss network, and details of the joints and hinges are described. When networked with other octahedral subsets, a compact stow package could be expanded into a rigid three-dimensional framework.

Other patents describe continued work in expandable networks to meet the needs of International Space Station. For example, the U.S. patent to Natori U.S. Pat. No. 4,655,022, employs beams and triangular plates to form tetrahedral units that provide a linear truss. The patent details both joint and hinge details and the stowage and deployment kinematics. Similarly, the U.S. patent to Kitamura et al, U.S. Pat. No. 5,085,018, describes a design based on triangular plates, hinged cross members, and ties to build expanding masts from very small packages.

A series of U.S. patents to Onoda, U.S. Pat. Nos. 4,667,451, 4,745,725, 4,771,585, 4,819,399 and 5,040,349 and an article by Onoda et al, entitled: "Two-Dimensional Deployable Hexapod Truss," Journal of Spacecraft and Rockets, Vol. 33, No. 3, May–June 1996, pp. 416–421, detail a number of examples of collapsible/deployable square truss units using struts and ties. Some suggested applications included box section, curved frames for building solar reflectors or antennas. The U.S. patent to M. Rhodes et al, U.S. Pat. No. 5,016,418, describes a more practical design that uses no ties, but employs hinges to build a rectangular box from a tube stowage volume. In addition, the U.S. patents to Krishnapillai, U.S. Pat. No. 5,167,100 and Skelton, U.S. Pat. No. 5,642,590, describe the use of radial struts and strut/tie combinations, respectively.

An article by B. F. Knight et al. entitled: "Innovative Deployable Antenna Developments Using Tensegrity Design," Abstract for the 41$^{st}$ AIAA Structures Conference, April 2000, and an article by A. Hoover entitled: "For 21$^{st}$-Century Campers and Soldiers, A Tent That Sets Itself Up," UF News, December 1999, page 30, describe the potential use of tensegrity support structures for antennas, but offer no teaching of how to integrate or mount a reflector membrane, e.g. a reflector mesh, to the structure to ensure proper deployment in the desired antenna operating shape.

Thus, there is a desire to provide a mounting device and method for mounting a reflector to a tensegrity support structure to ensure proper deployment of the reflector in the desired antenna operating shape.

SUMMARY OF THE INVENTION

In view of the foregoing background, it is therefore an object of the invention to provide a reflector assembly or antenna using tensegrity support architecture with a mounting frame for connection to and reliable deployment of the reflector.

This and other objects, features and advantages in accordance with the present invention are provided by a reflector assembly or antenna including a tensegrity structure having a plurality of compression members and a plurality of tension members connected thereto. The tensegrity structure is movable between stored and deployed positions. The assembly includes an actuator for selectively moving the tensegrity structure to the deployed position, a reflective member, such as an electrically conductive mesh, movable to an operating shape, and a mounting frame for connecting the reflective member to the tensegrity structure so that the reflective member is in the operating shape when the tensegrity structure is in the deployed position. The operating shape is preferably a parabolic dish.

The mounting frame may include a plurality of base members carried by the tensegrity structure, and a plurality of hanger members connected between the base members and the relective member. Furthermore, each of the base members and each of the hanger members preferably comprise a flexible elongate member.

In one embodiment, the plurality of base members may comprise a plurality of primary base members connected to the tensegrity structure, and a plurality of secondary base members connected between primary base members. The hanger members are connected between the secondary base members and the relective member. The secondary base members are arranged in a plurality of spaced apart sets, each set defining a polygonal shape, and each successive set defining a reduced area polygonal shape. Also, each compression and tension member has an elongate shape with opposing ends with respective adjacent ends of the compression and tension members defining a node of the tensegrity structure therebetween. Each primary base member has an elongate shape and opposing ends connected to respective nodes of the tensegrity structure.

Each base member has an elongate shape and opposing ends connected to respective compression members or tension members along medial portions thereof. Each of the compression members is preferably rigid, and each of the tension members is preferably flexible. Also, the actuator preferably selectively moves the tensegrity structure to the deployed position via a screw motion. Of course an antenna feed may be provided adjacent the tensegrity structure for receiving radio waves reflected from the reflective member and transmitting radio waves to the reflective member.

Objects, features and advantages in accordance with the present invention are also provided by a method of deploying a mesh reflector antenna including providing a reflective member, such as an electrically conductive mesh, movable to an operating shape, such as a parabolic dish, and connecting the electrically conductive reflector to a tensegrity structure via a mounting frame. Again, the tensegrity structure is deployable from a stored position to a deployed position and comprises a plurality of compression members and a plurality of tension members connected thereto. The mounting frame connects the electrically conductive reflector to the tensegrity structure so that the electrically conductive reflector attains the operating shape when the tensegrity structure is deployed to the deployed position. The method also includes deploying the tensegrity structure via an actuator.

DETAILED DESCRIPTION OF THE PREFERRED EMBODIMENTS

Figure 1:
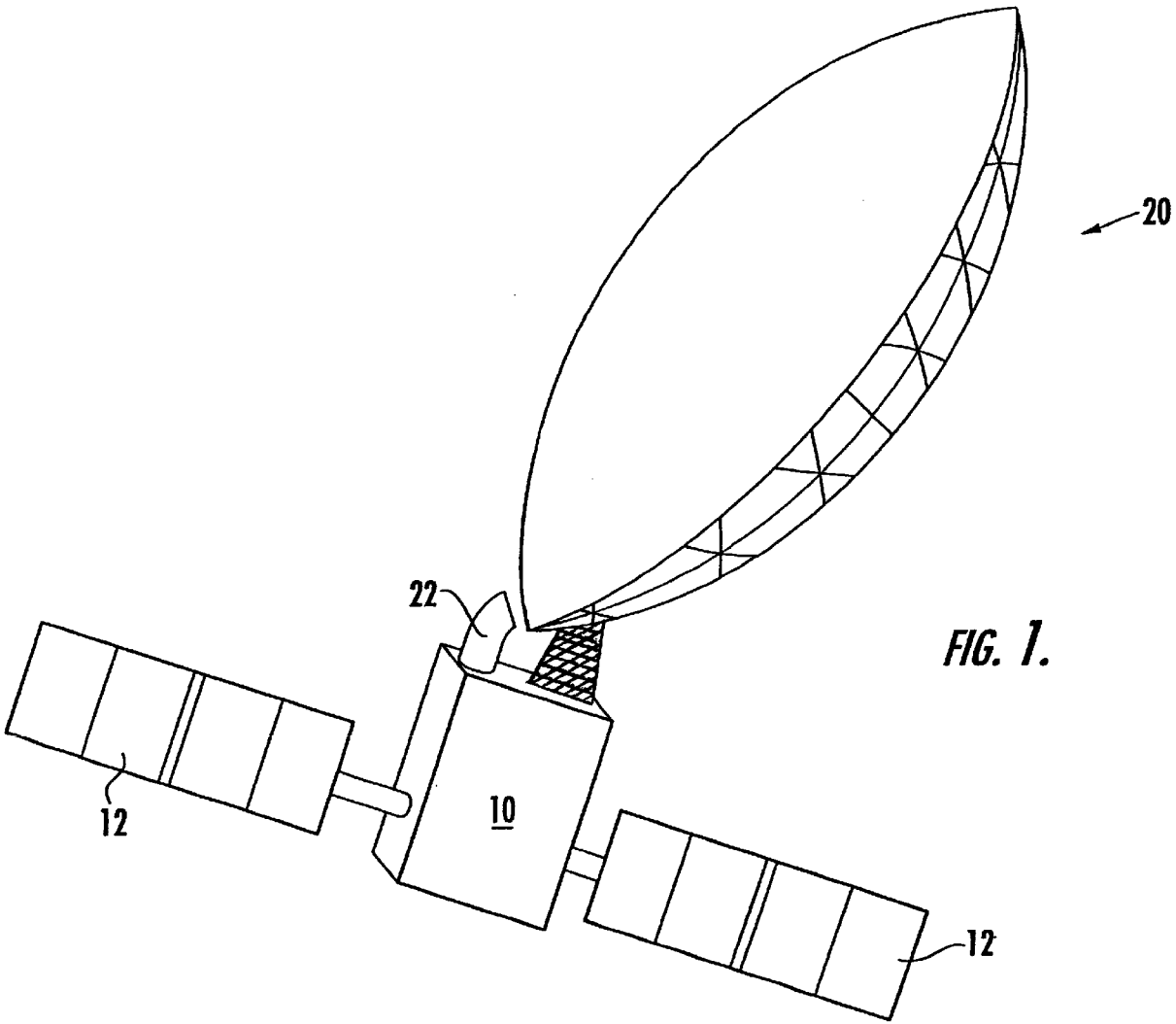
FIG. 1 is a schematic diagram of a satellite including a deployable antenna in accordance with the present invention.
Figure 2A:
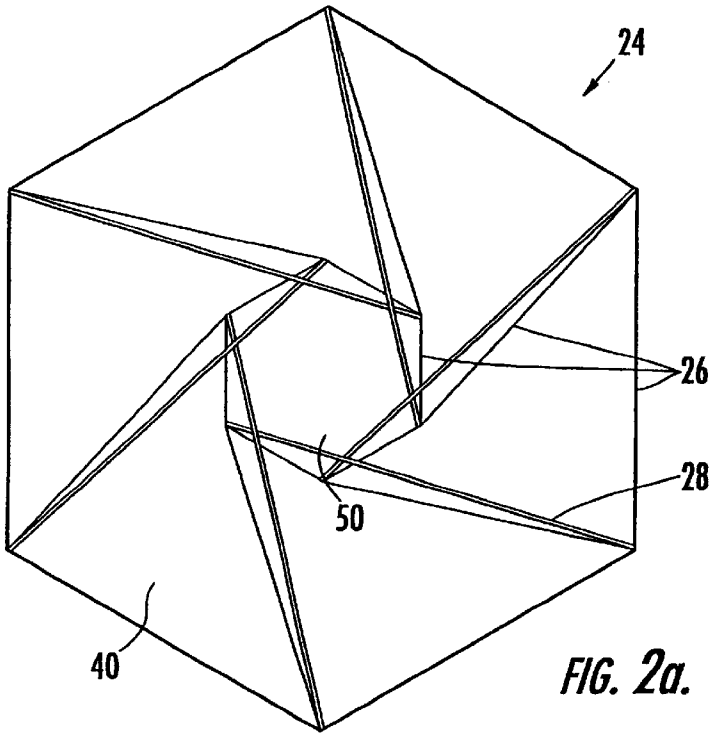
FIGS. 2*a*–2*d* are various views of the tensegrity support architecture for the deployable antenna of FIG. 1.
Figure 2B:
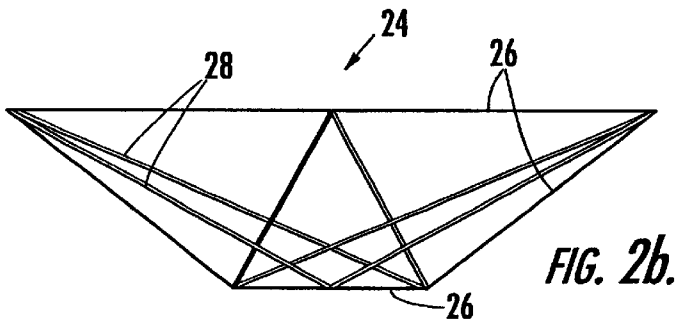
Figure 2C:
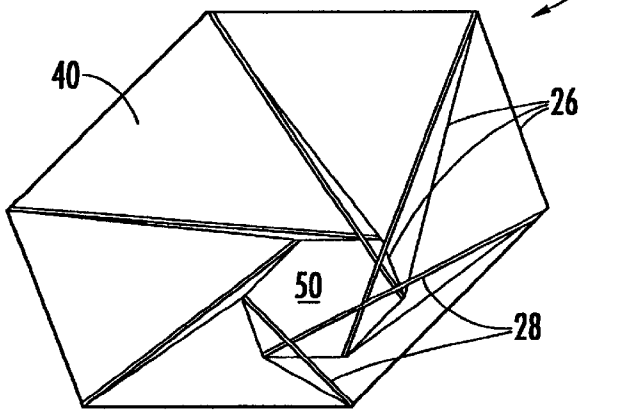
Figure 2D:
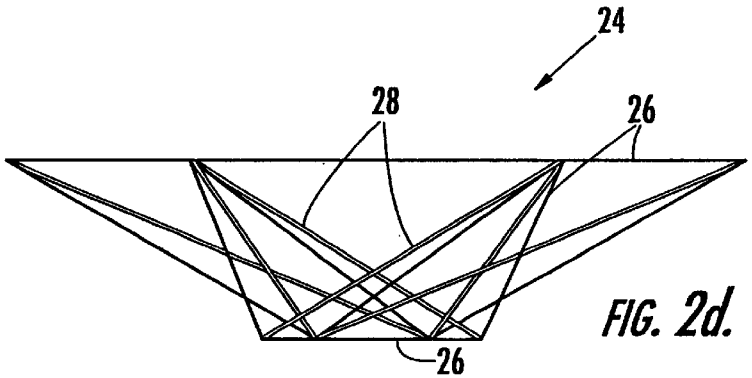
Figure 3C:
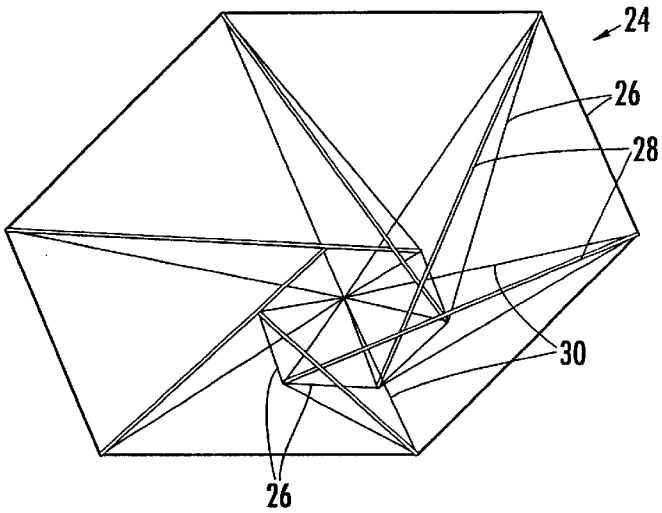
FIGS. 3*a*–3*d* and 4*a*–4*d* are various views of a first embodiment of the mounting frame for the tensegrity support architecture of FIGS. 2*a*–2*d*.
Figure 3D:
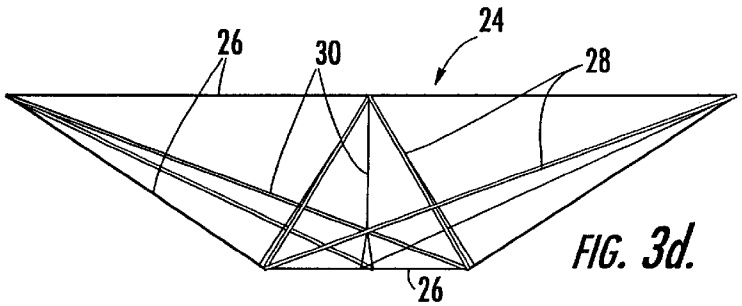
Figure 3A:
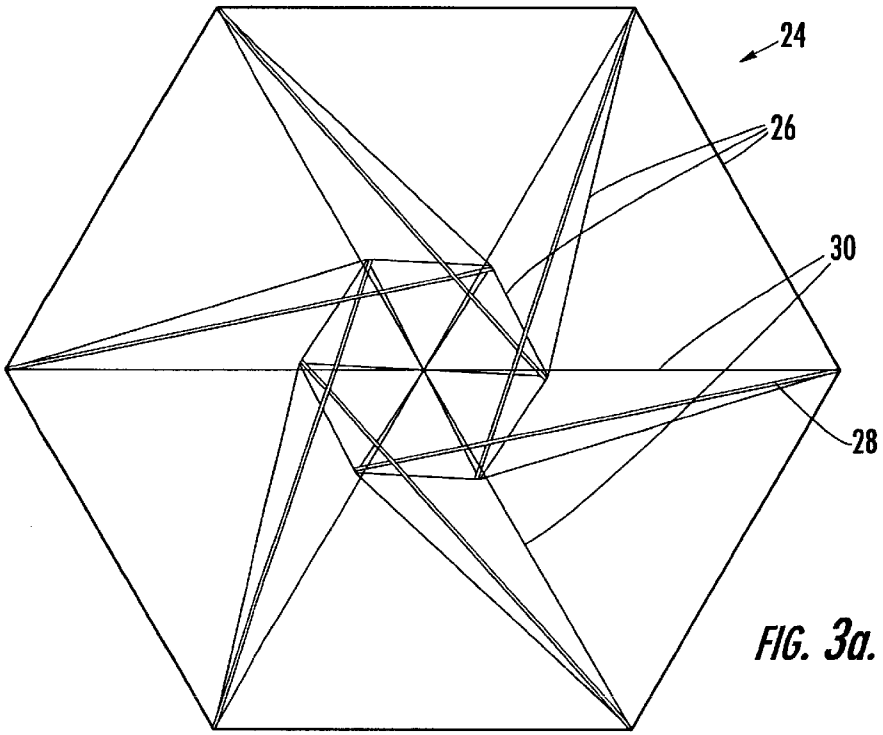
Figure 3B:
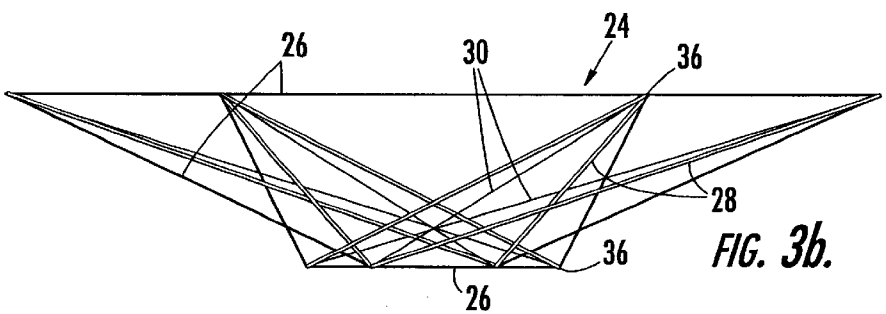
Figure 4A:
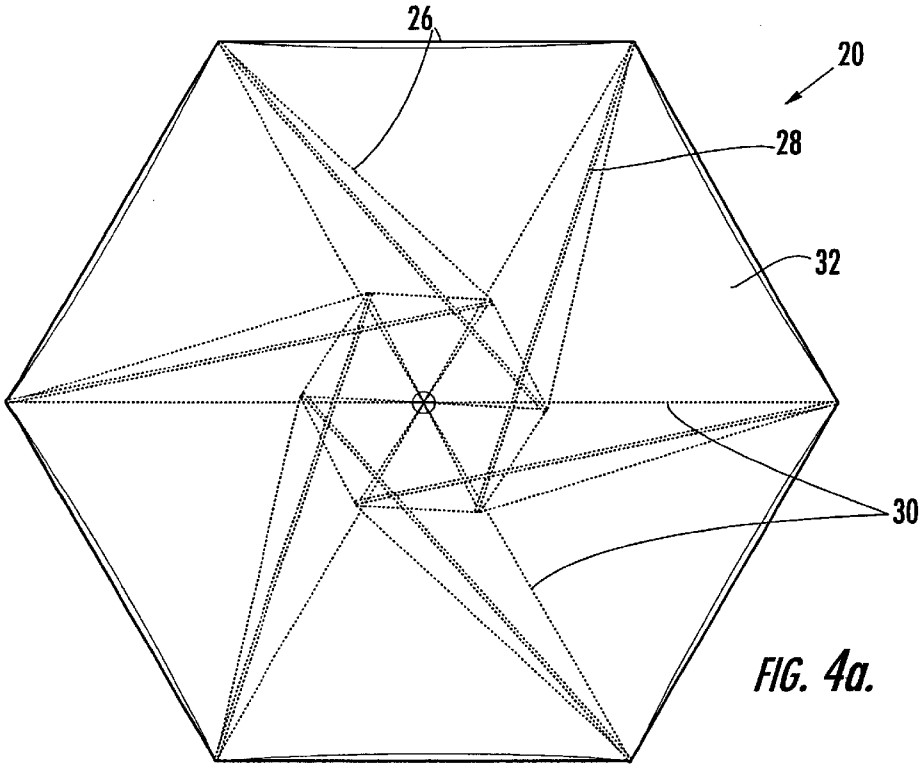
Figure 4B:
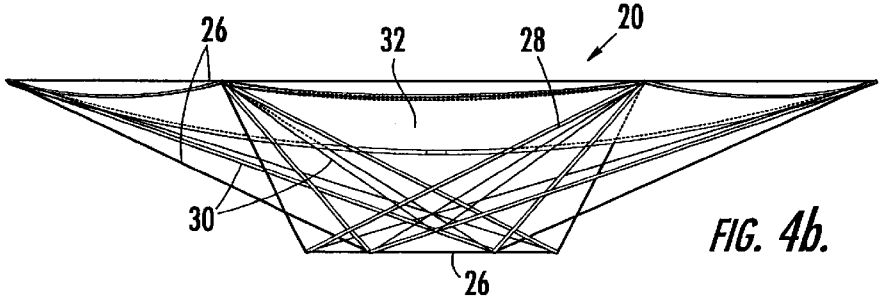
Figure 4C:
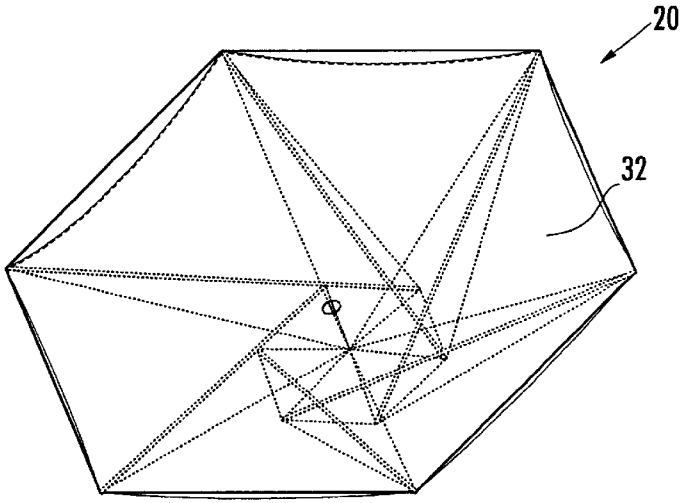
Figure 4D:
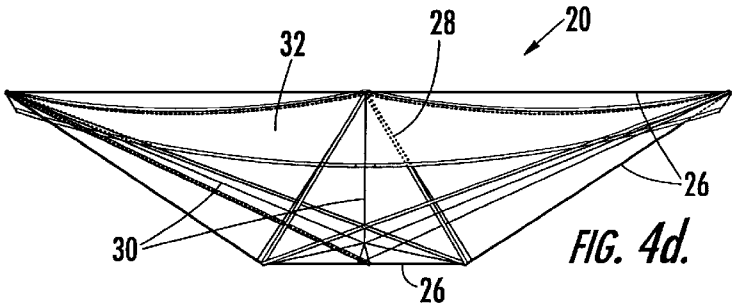
Figure 5A:
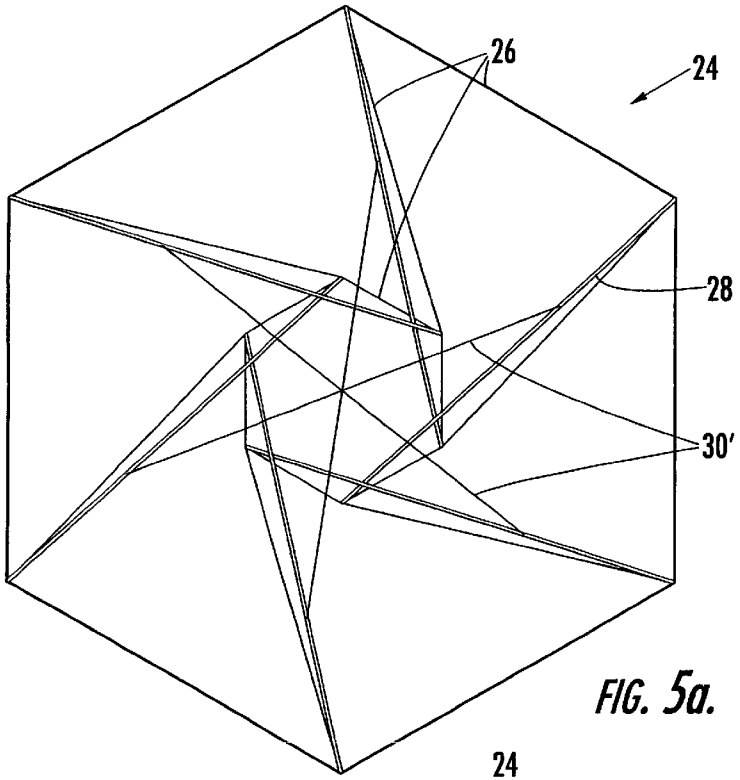
FIGS. 5*a*–5*d* are various views of another embodiment of the mounting frame for the tensegrity support architecture of FIGS. 2*a*–2*d*.
Figure 5B:
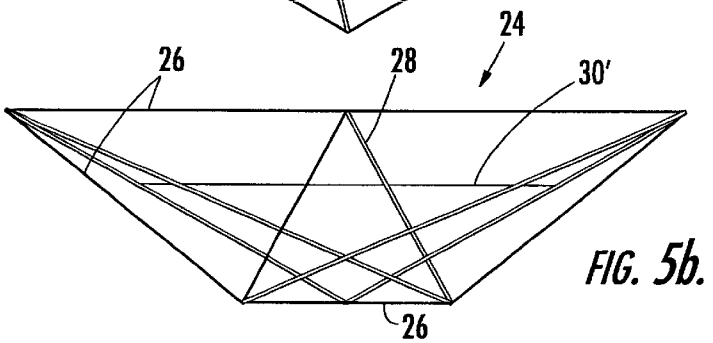
Figure 5C:
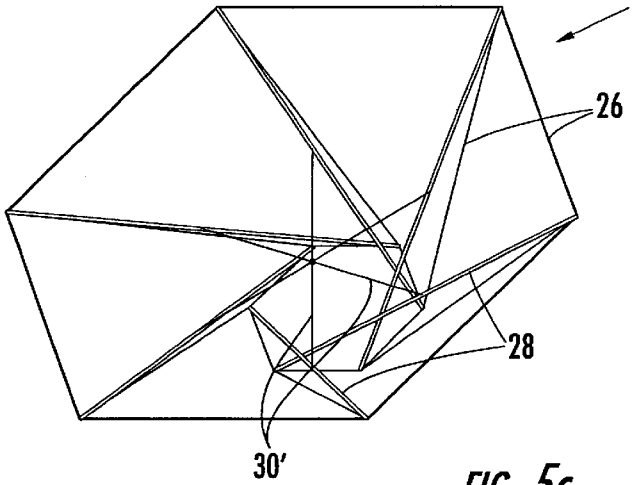
Figure 5D:
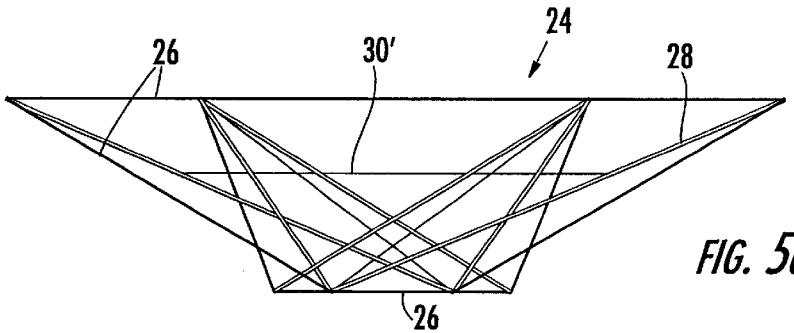
Figure 6:
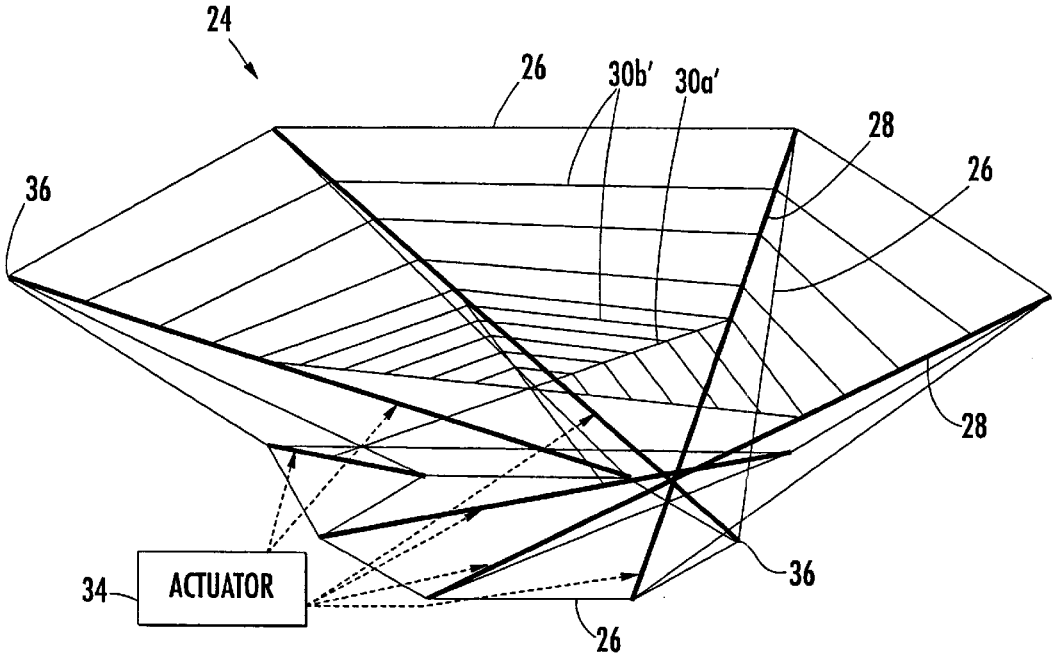
FIGS. 6 and 7 are plan views of the mounting frame for the tensegrity support architecture of FIGS. 2*a*–2*d*.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

As pointed out above, the underlying architecture of the antenna support of the present invention is a 'tensegrity' structure, which is not only highly stable, but enjoys a substantial increase in stowed package density for space deployed antenna applications. To facilitate an appreciation of the use of a tensegrity-based support arrangement for deploying and controlling the characteristics of an energy focusing surface, such as but not limited to a parabolic antenna, which will be described herein for purposes of providing an illustrative example, it is initially useful to examine the overall geometry and properties of a tensegrity structure.

The term 'tensegrity' is a kinematic approach to support structures derived from the two words 'tensile' and 'integrity'. It is described in an article by R. Connelly et al, entitled: "Mathematics and Tensegrity," American Scientist, Vol. 86, March–April 1998, pp. 142–151. Tensegrity was originally developed for architectural sculptures by K. Snelson in 1948. The tensegrity structure itself is described, for example, in the 1962 U.S. Pat. No. 3,063,521 to Fuller. A principal advantage of this type of design is that there is a minimum of compression elements (or struts); the stability of the tensegrity system is created through tension members (ties).

Further description of the tensegrity support architecture may be found in U.S. patent application Ser. No. 09/539,630 filed Mar. 30, 2000 by Knight et al. and entitled "Deployable Antenna Using Screw Motion-based Control of Tensegrity Support Architecture" which is incorporated by reference herein.

Referring to FIGS. 1–8, a deployable reflector antenna 20 in accordance with the present invention will now be described. The antenna 20 is typically part of a satellite 10. Of course the satellite may include solar panels 12 and other various structures and devices as would be appreciated by the skilled artisan. Reflector antennas, such as antenna 20, are used for traditional geostationary (GEO) satellites, fixed satellite service (FSS) and maritime mobile satellite service (MMSS) links at L-band, C-band and Ku-band which require antennas with high gain. Parabolic "dishes" have been the design of choice. These include a paraboloidal reflector illuminated directly by a set of feeds, such as feed 22, or indirectly through a system of subreflectors (not shown). The directly illuminated version is called a "prime focus fed" antenna. Indirectly illuminated versions are usually based on classical "folded" optical telescopes such as "Cassegrain" and "Gregorian" antennas for example.

Attention is now directed to FIGS. 2*a*–2*d*, which are diagrammatic top, side and perspective views of the tensegrity position of a 6—6 structure 24 for deploying a hexagonal platform 40 comprised of a plurality of tensioned ties 26, relative to a hexagonal base 50 also formed of a plurality of tensioned ties 26. Pursuant to the present invention, a regular polygon-based platform structure 24 for deploying and supporting an energy directing surface 32 (FIGS. 4*a*–4*d*), such as a parabolic radio wave antenna, is configured such that the lowest energy state for the platform structure is in a tensegrity position. The tensegrity structure includes rigid compression members or struts 28 connected by elastic tensioned ties or cords 26. From the illustrations, it can be seen that a deployable tensegrity structure 24 may be realized using platform kinematic mathematics to manipulate struts 28 between an upper platform 40 and a lower base 50. The stability of this structure 24 requires that the sum of the cord 26 forces matches the sum of the compression forces in the struts 28 that interconnect vertices of the platform 40 with the vertices of the base 50.

For purposes of providing a non-limiting illustrative example, the present invention is described for the case of a regular six-polygon or hexagon for each of the platform and base of the tensegrity structure 24, corresponding to a '6—6' parallel platform architecture. It should be observed, however, that the invention is not limited to use with a polygon of a specific number of sides. In accordance with fundamental geometry principles, as the number of sides of the polygon is increased, the perimeter of the polygon tends to acquire a more circular configuration. In terms of a practical implementation, a 6—6 structure 24 provides a reasonable number of compression support members and connection points for a furlable reflective medium 32 of which the antenna reflector surface is formed.

As used herein, the term "rigid" indicates that the struts 28 do not flex or elastically deform readily in order to sustain an axial compression load without bending, while the term "elastic" indicates that the cords 26 elastically deform when subjected to an axial tensile load, and will return to their prestressed condition once the load is removed. As those skilled in the art will appreciate, a wide variety of materials can be used for the struts 28 and cords 26. For example, the struts 28 and cords 26 may be formed of graphite or other high strength, light weight composites.

The tensegrity structure 24 is movable between stored and deployed positions. The assembly includes an actuator 34 (FIG. 6) for selectively moving the tensegrity structure 24 to the deployed position. The actuator preferably selectively moves the tensegrity structure to the deployed position via a screw or roatational motion. Of course an antenna feed 22 may be provided adjacent the antenna 20 and tensegrity structure 24 for receiving radio waves reflected from the reflective member 32 and transmitting radio waves to the reflective member. The reflective member 32, such as an electrically conductive mesh, is movable to an operating shape, via a mounting frame 30/31 for connecting the reflective member to the tensegrity structure 24 so that the reflective member is in the operating shape when the tensegrity structure is in the deployed position. The operating shape is preferably a parabolic dish as would be appreciated by those skilled in the art.

Figure 8:
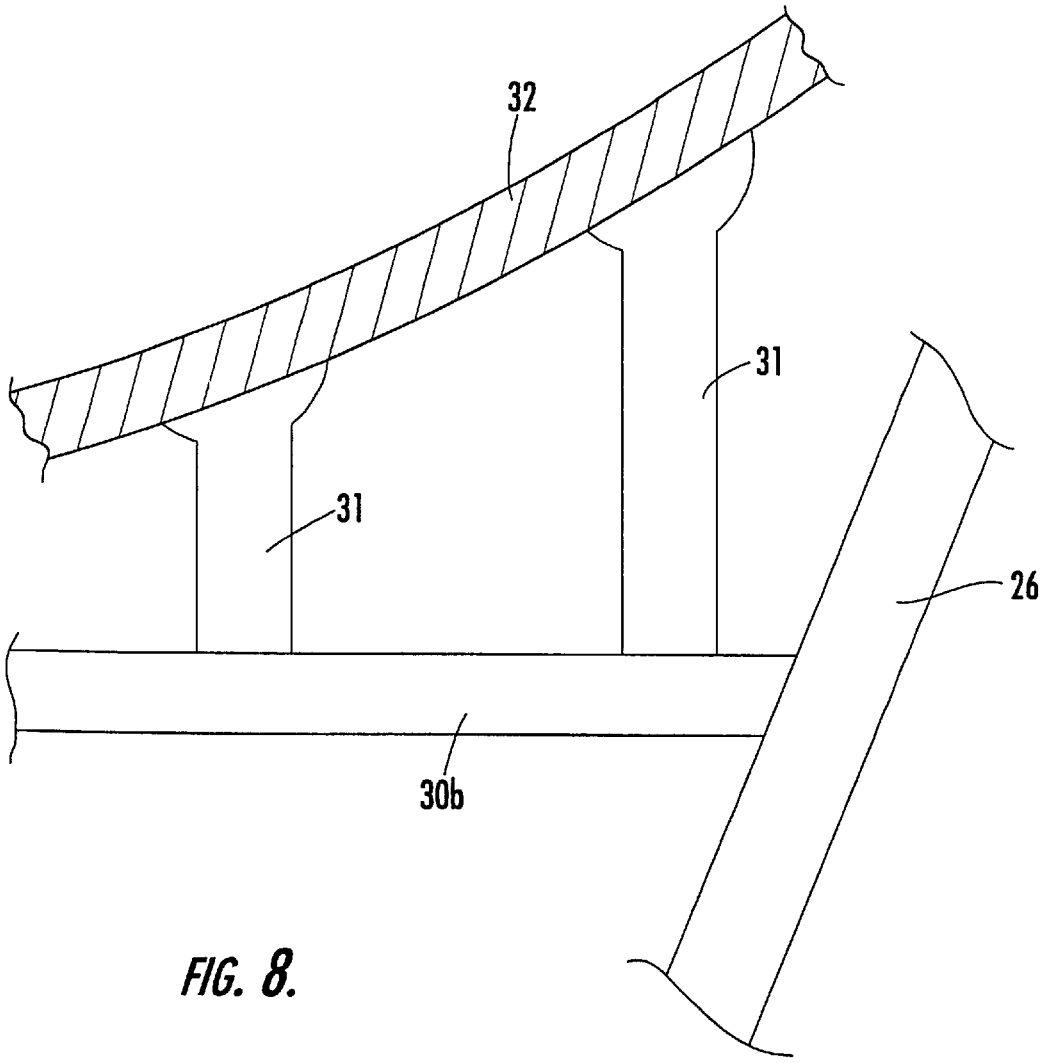
FIG. 8 is an enlarged view of a portion of the reflector and mounting frame of FIGS. 4*a*–4*d*.

As can be seen in the enlarged view of FIG. 8, the mounting frame 30/31 may include a plurality of base members 30 carried by the tensegrity structure, and a plurality of hanger members 31 connected between the base members and the relective member 32. Each of the base members 30 and each of the hanger members 31 preferably comprise a flexible elongate member.

Figure 7:
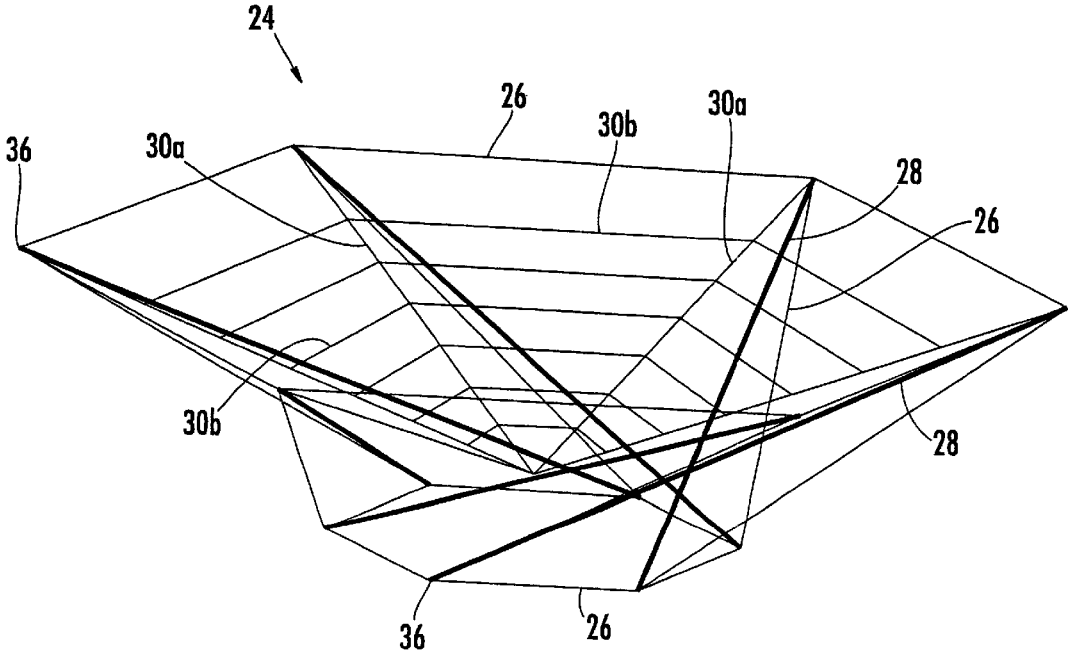

Referring to FIG. 7, in one embodiment of the mounting frame 30/31, the plurality of base members 30 may comprise a plurality of primary base members 30*a* connected to the tensegrity structure 24, and a plurality of secondary base members 30*b* connected between primary base members. The hanger members 31 are connected between the secondary base members 30*b* and the relective member 32. The secondary base members 30*b* are arranged in a plurality of spaced apart sets, each set defining a polygonal shape, and each successive set (in the direction from the platform 40 to the base 50) defining a reduced area polygonal shape.

Also, each strut 28 and cord 26 has an elongate shape with opposing ends. Respective adjacent ends define nodes 36 of the tensegrity structure therebetween. Referring to FIG. 7, each primary base member 30*a* may have an elongate shape and opposing ends connected to respective nodes 36 of the tensegrity structure. Referring to FIGS. 5*a*–5*d* and 6, in another embodiment, the base members 30' may be connected along medial portions of the struts 28. Here, some of the secondary base members 30*b*' near the top of the structure 24 are connected between struts 28, while some of the secondary base members are connected between primary base members 30*a*' for mounting the center portions of the reflective member 32.

Thus, a deployable antenna 20 having a tensegrity support structure 24 and mounting frame 30/31 of the present invention has improved specific mass, compact stowage volume and high deployment reliability. The reflective member 32 is mounted to the tensegrity support structure 24 via the mounting frame 30/31 which ensures proper deployment of the reflector in the desired antenna operating shape.

A method of deploying the reflector antenna includes providing the reflective member 32 and connecting it to a tensegrity structure 24 via a mounting frame 30/31. Again, the tensegrity structure 24 is deployable from a stored position to a deployed position and comprises a plurality of compression members 28 and a plurality of tension members 26 connected thereto. The mounting frame 30/31 connects the reflector 32 to the tensegrity structure 24 so that the reflector attains the operating shape when the tensegrity structure is deployed to the deployed position. The method also includes deploying the tensegrity structure 24 via an actuator 34.

The number of base members 30 should be minimized to reduce weight. Increasing the number will not reduce loads in the structure 24 but will improve the outer surface of the reflector 32, e.g. reducing scalloping. The appropriate number of base members 30 can be determined by balancing these factors.

A twist angle a of a parallel prism to form the tensegrity structure 24 can be calculated by: a=90°–180°/n, as discussed by Hugh Kenner in "Geodesic Math and How to Use it," p.9, 1976. A reinforcing twist angle $\alpha$ is determined by the required stiffness of the reflector 32. As the stiffness required increases, so will $\alpha$, which is intitially determined by static analysis at end points of the structure 24. This will be based on estimates of the force requirements of the base members 30. The optimum stiffness position will be $a+\alpha$.

The minimum acceptable focal length to diameter ratio f/d of the mesh reflector should also be determined. The geometry of the tensegrity structure 24 should satisfy:

$$\frac{f}{d} < \frac{\sqrt{r^2\cos^2(a+\alpha)+\frac{d^2}{4}-d\cdot r\cos(a+\alpha)}}{4h}$$

where r is the radius of the non-surface side of the tensegrity structure 24, and h is the height. The f/d should be greater than the right side of the inequality to provide for physical space between the stuts 28 and the base members 30. The most cost-effective r/h ratio should be determined for a required implementation.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A reflector assembly comprising:

a tensegrity structure comprising a plurality of compression members and a plurality of tension members connected thereto, said tensegrity structure being movable between stored and deployed positions;

at least one actuator for selectively moving said tensegrity structure to the deployed position;

a reflective member movable to an operating shape; and a mounting frame for connecting said reflective member to said tensegrity structure so that said reflective member is in the operating shape when said tensegrity structure is in the deployed position.

2. A reflector assembly according to claim 1 wherein said mounting frame comprises:

a plurality of base members carried by said tensegrity structure; and a plurality of hanger members connected between said base members and said reflective member.

3. A reflector assembly according to claim 2 wherein each of said base members comprises a flexible elongate member.

4. A reflector assembly according to claim 2 wherein each of said hanger members comprises a flexible elongate member.

5. A reflector assembly according to claim 2 wherein said plurality of base members comprises;

a plurality of primary base members connected to said tensegrity structure; and a plurality of secondary base members connected between primary base members, the hanger members being connected between said secondary base members and said relective member.

6. A reflector assembly according to claim 5 wherein said secondary base members are arranged in a plurality of spaced apart sets, each set defining a polygonal shape; and wherein each successive set defines a reduced area polygonal shape.

7. A reflector assembly according to claim 5 wherein each compression and tension member has an elongate shape with opposing ends; wherein respective adjacent ends of the compression and tension members define a node of said tensegrity structure therebetween; wherein each primary base member has an elongate shape and opposing ends; and wherein the ends of each primary base member are connected to respective nodes of said tensegrity structure.

8. A reflector assembly according to claim 2 wherein each base member has an elongate shape and opposing ends connected to respective compression members along medial portions thereof.

9. A reflector assembly according to claim 2 wherein each base member has an elongate shape and opposing ends connected to respective tension members along medial portions thereof.

10. A reflector assembly according to claim 1 wherein each of said compression members comprises a rigid elongate member.

11. A reflector assembly according to claim 1 wherein each of said tension members comprises a flexible elongate member.

12. A reflector assembly according to claim 1 wherein the at least one actuator selectively moves said tensegrity structure to the deployed position via a rotational motion.

13. A reflector assembly according to claim 1 wherein said reflective member comprises an electrically conductive surface.

14. A reflector assembly according to claim 1 wherein the operating shape of said reflective member is a parabolic dish.

15. A reflector antenna comprising:

a tensegrity structure comprising a plurality of compression members and a plurality of tension members connected thereto, said tensegrity structure being deployable from a stored position to a deployed position;

at least one actuator for selectively deploying said tensegrity structure;

an electrically conductive reflector movable to an operating shape;

an antenna feed adjacent the tensegrity structure for at least one of receiving radio waves reflected from said electrically conductive reflector and transmitting radio waves to said electrically conductive reflector; and a mounting frame for connecting said electrically conductive reflector to said tensegrity structure so that said electrically conductive reflector attains the operating shape when said tensegrity structure is deployed to the deployed position.

16. An antenna according to claim 15 wherein said mounting frame comprises:

a plurality of base members carried by said tensegrity structure; and a plurality of hanger members connected between said base members and said electrically conductive reflector.

17. An antenna according to claim 16 wherein each of said base members comprises a flexible elongate member.

18. An antenna according to claim 16 wherein each of said hanger members comprises a flexible elongate member.

19. An antenna according to claim 16 wherein said plurality of base members comprises;

a plurality of primary base members connected to said tensegrity structure; and a plurality of secondary base members connected between primary base members, the hanger members being connected between said secondary base members and said electrically conductive reflector.

20. An antenna according to claim 19 wherein each compression and tension member has an elongate shape with opposing ends; wherein respective adjacent ends of the compression and tension members define a node of said tensegrity structure therebetween; wherein each primary base member has an elongate shape and opposing ends; and wherein the ends of each primary base member are connected to respective nodes of said tensegrity structure.

21. An antenna according to claim 16 wherein each base member has an elongate shape and opposing ends connected to respective compression members along medial portions thereof.

22. An antenna according to claim 15 wherein the operating shape of said electrically conductive reflector is a parabolic dish.

23. A method of deploying a reflector antenna comprising:

providing an electrically conductive reflector movable to an opera ting shape;

connecting the electrically conductive reflector to a tensegrity structure via a mounting frame, the tensegrity structure being deployable from a stored position to a deployed position and comprising a plurality of compression members and a plurality of tension members connected thereto, the mounting frame connecting the electrically conductive reflector to the tensegrity structure so that the electrically conductive reflector attains the operating shape when the tensegrity structure is deployed to the deployed position; and deploying the tensegrity structure via at least one actuator.

24. A method according to claim 23 wherein the mounting frame comprises:

a plurality of base members carried by the tensegrity structure; and a plurality of hanger members connected between the base members and the electrically conductive reflector.

25. A method according to claim 24 wherein each of the base members comprises a flexible elongate member.

26. A method according to claim 24 wherein each of the hanger members comprises a flexible elongate member.

27. A method according to claim 24 wherein the plurality of base members comprises;

a plurality of primary base members connected to the tensegrity structure; and a plurality of secondary base members connected between primary base members, the hanger members being connected between the secondary base members and the electrically conductive reflector.

28. A method according to claim 27 wherein each compression and tension member has an elongate shape with opposing ends; wherein respective adjacent ends of the compression and tension members define a node of the tensegrity structure therebetween; wherein each primary base member has an elongate shape and opposing ends; and wherein the ends of each primary base member are connected to respective nodes of the tensegrity structure.

29. A method according to claim 24 wherein each base member has an elongate shape and opposing ends connected to respective compression members along medial portions thereof.

30. A method according to claim 23 wherein the operating shape of the electrically conductive reflector is a parabolic dish.

* * * * *